US006283228B2

(12) United States Patent
Collee et al.

(10) Patent No.: US 6,283,228 B2
(45) Date of Patent: Sep. 4, 2001

(54) METHOD FOR PRESERVING CORE SAMPLE INTEGRITY

(75) Inventors: Pierre Emmanuel Collee, Houston; Steven R. Radford, The Woodlands; William A. Mallow, Heiotes; Dorothy P. Enright, Houston, all of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/737,877

(22) Filed: Dec. 15, 2000

Related U.S. Application Data

(63) Continuation of application No. 09/201,686, filed on Nov. 30, 1998, which is a continuation-in-part of application No. 08/780,560, filed on Jan. 8, 1997, now Pat. No. 5,881,825.

(51) Int. Cl.[7] ..... E21B 49/00; E21B 49/02; E21B 25/08

(52) U.S. Cl. ..... 175/58; 175/226

(58) Field of Search ..... 175/58, 59, 226, 175/20, 40, 60, 249; 73/152.09, 152.11

(56) References Cited

U.S. PATENT DOCUMENTS

| | | | |
|---|---|---|---|
| 1,999,147 | 4/1935 | Ambrose et al. . | |
| 2,146,263 | 2/1939 | Johnston . | |
| 2,510,300 | 6/1950 | Walls . | |
| 2,514,585 | 7/1950 | Natland . | |
| 2,531,083 | 11/1950 | Smith . | |
| 2,537,605 | 1/1951 | Sewell . | |
| 2,779,195 | 1/1957 | Simon . | |
| 2,880,969 | 4/1959 | Williams . | |
| 3,064,742 | 11/1962 | Bridwell . | |
| 3,086,602 | 4/1963 | Henderson . | |
| 3,112,799 | 12/1963 | Gallus . | |
| 3,123,158 | 3/1964 | Gallus . | |
| 3,207,240 | 9/1965 | Hugel . | |
| 3,302,733 * | 2/1967 | Humphrey | 175/59 |
| 3,302,734 | 2/1967 | Meadors . | |
| 3,314,489 | 4/1967 | Humphrey . | |
| 3,467,208 | 9/1969 | Kelly, Jr. . | |

(List continued on next page.)

FOREIGN PATENT DOCUMENTS

| | | |
|---|---|---|
| 141 069 | 4/1980 | (DE) . |
| 0 403 437 A2 | 12/1990 | (EP) . |
| 2152109 | 7/1985 | (GB) . |
| 509815 | 4/1976 | (RU) . |
| 517828 | 6/1976 | (RU) . |
| 1234577 A1 | 5/1986 | (SU) . |
| 1239260 | 6/1986 | (SU) . |
| 1302168 | 4/1987 | (SU) . |

OTHER PUBLICATIONS

"Crumbly cores? Dip them in plastisc and freeze", The Oil and Gas Journal, May 31, 1965, p. 40.

*Primary Examiner*—Brian L. Johnson
*Assistant Examiner*—Joselynn Y Sliteris
(74) *Attorney, Agent, or Firm*—Paula D Morris & Associates, P.C.

(57) ABSTRACT

A method for protecting integrity of a core sample during transport from a subterranean formation to the surface comprising: cutting a core sample from the subterranean formation using a drilling fluid; encapsulating the core sample with an encapsulating material that is separate from the drilling fluid and comprises a property which renders the encapsulating material capable of protecting the chemical integrity of the core sample during transport from the subterranean formation to the surface, wherein the property is other than a property selected from the group consisting of a viscosity which increases in response to a decrease in temperature and an ability to solidify in response to a decrease in temperature; and, transporting the encapsulated core sample from the subterranean formation to the surface.

8 Claims, 1 Drawing Sheet

U.S. PATENT DOCUMENTS

| | | | | |
|---|---|---|---|---|
| 3,521,715 | | 7/1970 | Krutein . | |
| 3,548,958 | | 12/1970 | Blackwell et al. . | |
| 3,718,195 | | 2/1973 | Clements . | |
| 3,841,419 | | 10/1974 | Russell . | |
| 4,098,361 | | 7/1978 | Lamothe . | |
| 4,256,192 | | 3/1981 | Aumann . | |
| 4,272,987 | | 6/1981 | Aumann et al. . | |
| 4,312,414 | | 1/1982 | Park . | |
| 4,321,968 | | 3/1982 | Clear . | |
| 4,449,594 | | 5/1984 | Sparks . | |
| 4,479,557 | | 10/1984 | Park et al. . | |
| 4,505,161 | * | 3/1985 | Hunt et al. | 175/152.11 |
| 4,598,777 | | 7/1986 | Park et al. . | |
| 4,716,974 | | 1/1988 | Radford et al. . | |
| 4,848,487 | | 7/1989 | Anderson et al. . | |
| 5,360,074 | * | 11/1994 | Colle et al. | 175/58 |
| 5,482,123 | * | 1/1996 | Collee | 175/58 |
| 5,546,798 | | 8/1996 | Collee et al. . | |
| 5,560,438 | | 10/1996 | Collee et al. . | |

* cited by examiner

METHOD FOR PRESERVING CORE SAMPLE INTEGRITY

CROSS REFERENCES TO RELATED APPLICATIONS

The instant application is a continuation of pending application Ser. No. 09/201,686 filed Nov. 30, 1998, which is a continuation-in-part of application Ser. No. 08/780,560 filed Jan. 8, 1997, now U.S. Pat. No. 5,881,825.

FIELD OF THE INVENTION

The present invention relates to a technique for maintaining the integrity of a downhole core sample which must be brought to the surface in order to analyze a subsurface formation.

BACKGROUND OF THE INVENTION

In order to analyze the amount of oil contained in a particular soil at a particular depth in a subterranean well, a core or core sample of the well formation typically is extracted and brought to the surface for analysis. If the core sample has retained its mechanical (or physical) and chemical integrity during the trip from downhole to the surface, then an analysis of the core sample will yield accurate data about the percent of fluid and/or gas contained in the formation. The resulting data then may be used to determine the type(s) of fluid—especially oil—that is contained in the formation.

Unfortunately, it is difficult to maintain the physical and/or chemical integrity of the core sample during its journey from downhole to the surface. Downhole, the oil and/or water in the formation may contain dissolved gas which is maintained in solution by the extreme pressure exerted on the fluids when they are in the formation. However, unless a pressure core barrel is used, the pressure on the core when the core is downhole will differ dramatically from the pressure experienced on the core sample as the core sample is brought to the surface.

As the pressure on the core sample decreases during the trip to the surface, the fluids in the core tend to expand, and any gas dissolved in the oil or water contained in the sample will tend to come out of solution. In addition, any "mobile oil," or oil that passes through the core in a manner dependent on the permeability, porosity, and/or volume of fluid contained therein, may drain or bleed out of the core and be lost. If protective measures are not taken, then this sellable gas, mobile oil, and/or some water may be lost during transport of the core to the surface. As a result, the core sample will not accurately represent the composition of the downhole formation.

One means for dealing with the foregoing problem is pressure coring, or transporting the core to the surface while maintaining the downhole pressure on the core. Pressure coring helps to maintain both the mechanical and chemical integrity of the core. However, pressure coring is expensive for a number of reasons, including: the manpower required; the many difficulties that must be overcome to effectively handle the pressurized core; and, the expensive procedures required to analyze the pressurized core once it reaches the surface.

Another technique that has been used in an attempt to maintain core integrity is known as sponge coring. In sponge coring, an absorbent sponge or foam material is disposed about the core so that fluids forced out of the core during depressurization are absorbed by the adjacent sponge layer. However, sponge coring has a number of disadvantages.

Sponge coring typically does not provide accurate data regarding the structure of the formation because of inadequate saturation, and because the wettability of the sponge varies with variations in temperature and pressure. Also, the sponge does not protect the core from the drastic changes in pressure experienced during transport of the core to the surface. Thus, the core geometry or mechanical integrity of the core sample may not be preserved during sponge coring. Also, even though the sponge may absorb some of the gas and/or oil that escapes from the core sample, some of that gas and/or oil also may be lost during transport. Finally, in order for the sponge sleeve to protect the core, the sponge sleeve must be in close contact with the core. Close contact is difficult to achieve in broken or unconsolidated cores. And, because of the high friction coefficient of the sponge, close contact between the sponge and the core can result in jamming within the coring tool even where the core is hard and consolidated.

Some improvement in sponge coring has been achieved by at least partially saturating the sponge with a pressurized fluid that (1) prevents drilling mud from caking on the sides of the core, and (2) prevents fluid loss from the core. The pressurized fluid is displaced from the sponge as the core enters the core barrel and compresses the sponge lining. However, "perfect saturation" of the sponge is impossible as a practical matter. Thus, air tends to remain trapped in the sponge and skew the final analysis of the formation. Even if the sponge is presaturated, gas and solution gas expelled from the core sample tends to be lost. Therefore, the sponge does not accurately delineate the gas held in the formation. For these and other reasons, sponge coring, even with presaturation, leaves much to be desired.

Other techniques for maintaining core integrity involve changing the composition of the drilling mud that is used so that the drilling mud does not contaminate the core, resulting in an erroneous analysis of core content. In one such technique, a polymer containing two or more recurring units of two different polymers is incorporated in the drilling fluid in order to minimize variation in rheological properties at ambient versus high downhole temperatures. Another technique for changing the composition of the drilling mud is to mix an oil based fluid with an organophilic clay gelation agent to regulate the thixotropic qualities of the drilling mud or packer fluid. In some of such techniques, the drilling mud actually surrounds and gels to form a capsule around the core sample.

The disadvantage of the foregoing method of "encapsulating" the core sample using drilling mud in situ is that contact between the core sample and the drilling mud or coring fluid is one of the more common factors leading to contamination and unreliability of the core sample. Therefore, it is desirable to minimize contact between the drilling mud and the core sample.

Still others have used thermoplastics and thermosetting synthetics to encapsulate the core sample inside of the core barrel before transporting the sample to the surface. The disadvantage of these techniques is that thermoplastics and thermosetting synthetics require a chemical reaction to harden or viscosity. Furthermore, thermoplastic or thermosetting synthetics harden or "viscosify" in response to an increase in temperature, and will not respond to the natural decrease in temperature to which the core sample will be exposed as it is transported to the surface.

Furthermore, many factors downhole are capable of influencing or even interfering with the chemical reaction required to "harden" a thermoplastic or thermosetting resin.

For example, the chemical reaction required for encapsulation in some of these references is, itself, exothermic. The exothermicity of the chemical reaction may affect the timing of the encapsulation and the mechanical and/or chemical integrity of the resulting core sample. Similarly, oil contained in the reservoir may contain gas which comes out of solution before the chemical reaction is complete. The fact that an exothermic chemical reaction may be occurring in the thermoplastic or thermosetting resin at the same time that such gas may be liberated renders the sampling procedure unsafe. For example, the gas may explode upon exposure to any such sudden increase in temperature.

Other techniques for maintaining core integrity involve attempts to remove contaminants from the core before it is depressurized. One such technique is to flush the core before depressurization and to lubricate and/or wash the core as it enters the core barrel. Such techniques may help to maintain core "integrity" after flushing; however, flushing alters the original content of the core and therefore is inherently unreliable.

Some have attempted to develop compositions which will envelope the core and prevent any change in core composition until the envelope is removed. In one such technique, an aqueous gel, such as carboxymethylhydroxyethylcellulose (CMHEC), has been mixed with an aqueous brine solution and an alkaline earth metal hydroxide, such as calcium hydroxide, to form a gel which serves as a water diversion agent, a pusher fluid, a fracturing fluid, a drilling mud, and/or a workover or completion fluid. In another such technique, material with colligative properties, particularly a carbohydrate such as sucrose or starch, and optionally a salt, such as potassium chloride, has been added to the drilling mud to mitigate the osmotic loss of the aqueous phase of the drilling mud. Still others have tried pumping an oleophilic colloid through the drill string so that the colloid contacts and is dispersed in an oleaginous liquid forming gel which tends to plug the formation.

Unfortunately, none of these techniques has been completely successful in maintaining the physical and chemical integrity of a core sample during transport from downhole to the surface. Also, many of these techniques either are expensive or difficult, and may be dangerous to perform. A safe, economical, and efficient technique is needed by which the chemical and/or physical integrity of the core sample can be maintained while it is transported from downhole to the surface.

SUMMARY OF THE INVENTION

The present invention provides a method for protecting chemical integrity of a core sample during transport from a subterranean formation to the surface comprising: cutting a core sample from the subterranean formation using a drilling fluid; encapsulating the core sample with an encapsulating material that is separate from said drilling fluid and comprises a property which renders the encapsulating material capable of protecting the chemical integrity of said core sample during transport from the subterranean formation to the surface, wherein the property is other than a property selected from the group consisting of a viscosity which increases in response to a decrease in temperature and an ability to solidify in response to a decrease in temperature; and transporting the encapsulated core sample from the subterranean formation to the surface.

DETAILED DESCRIPTION OF THE INVENTION

Figure 1:
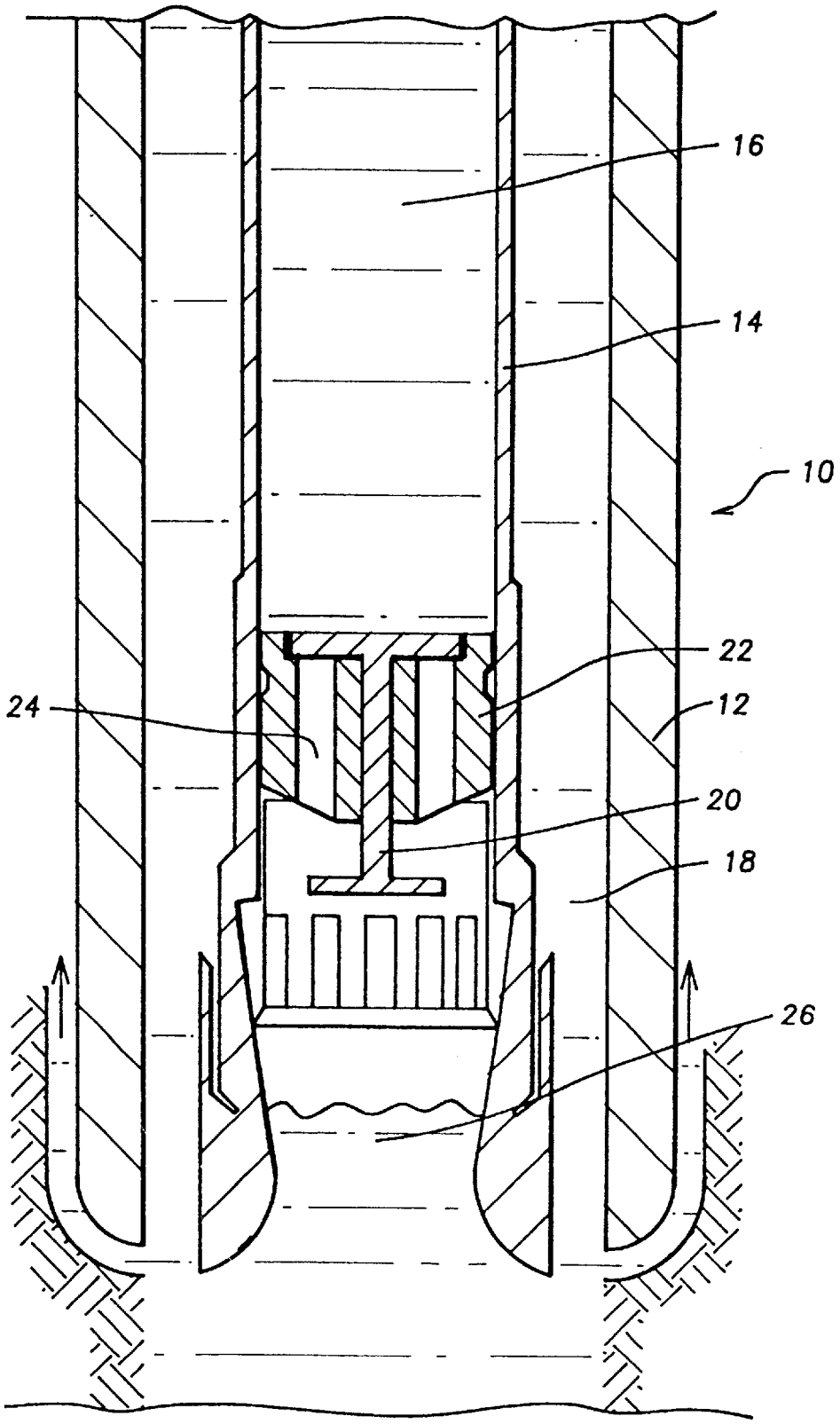
FIG. 1 is a cross sectional view of a segment of a drill bit suitable for use in conjunction with the present invention before encapsulation of the core sample.

The present invention is directed to substantially any material that is capable of "encapsulating" a core sample downhole and preserving the chemical and/or physical integrity of the core sample as the sample is transported from a subterranean formation to the surface. The claimed encapsulating materials are neither limited to particular compositions, nor to materials that protect core sample integrity by specific mechanisms. However, the claimed encapsulating materials must be capable of protecting core sample integrity without requiring a chemical reaction to change the properties of the encapsulating material. For example, the claims do not encompass synthetic thermoset and/or thermoplastic materials which require a chemical reaction to change their physical properties before those materials are capable of protecting core sample integrity during transport to the surface. Also, the property of the encapsulating material which renders the encapsulating material capable of protecting the integrity of the core sample during transport preferably is other than an ability to do one of the following in response to a decrease in surrounding temperature: (a) to increase in viscosity, or (b) to solidify. The encapsulating material preferably is capable of protecting the chemical integrity of the core sample in the absence of a change in surrounding conditions. In a preferred embodiment, the encapsulating material has sufficient lubricity to facilitate entry of the core sample into a core barrel or other transporting device without physical disruption of the core sample.

The claimed encapsulating materials are separate from the drilling fluid. The invention does not encompass drilling fluids that merely incorporate chemicals designed to enhance core sample integrity. In fact, one function of the claimed encapsulating materials is to minimize contact between the core sample and the drilling fluid to avoid contamination of the core sample by the drilling fluid.

The encapsulating materials of the present invention may protect the integrity of the core sample in any number of ways. In preferred embodiments, the encapsulating material either (1) is inherently capable of protecting the chemical integrity of the a core sample, or (2) swells in contact with water to form a plastic mass, which can be pumped into the core barrel to encapsulate the core sample and maintain the chemical and mechanical integrity of the sample during transport to the surface.

For purposes of the present application, the term "encapsulating material" is defined to include any material that: is separate from the drilling fluid; has a composition different from the drilling fluid; encapsulates the core sample without readily penetrating the core sample; encapsulates the core sample without readily altering the chemical integrity of the core sample; and, protects the integrity of the core sample during transport from a subterranean formation to the surface. The claimed "encapsulating materials" achieve such protection without: (a) requiring a chemical reaction to change the properties of the encapsulating material; (b) increasing in viscosity in response to a decrease in surrounding temperature; or (c) solidifying in response to a decrease in surrounding temperature. Given the teachings of the present invention, persons of ordinary skill in the art will be able to develop other compositions that fall within the spirit and scope of the present invention without undue experimentation.

In a preferred embodiment, the encapsulating material comprises a polyalkylene derivative, such as polyethylene, which is capable of protecting a core sample from formations at relatively high temperatures of 250° F. or higher, or a derivative thereof, such as ethylene/vinyl acetate copolymer, which would preferably be used with formations having relatively lower temperatures.

The encapsulating material of the present invention varies in composition depending upon the characteristics of the formation to be sampled. For example, a highly permeable formation will require a highly viscous encapsulating material that will not invade the core sample. In contrast, a core sample from a tighter formation having very little permeability could be protected using an encapsulating material that is not as highly viscous because the tendency of the encapsulating material to invade the core sample will be reduced.

Some polyglycols, such as polypropylene glycol, are viscous both at relatively high temperatures and at room temperature. Such naturally viscous polyglycols are capable, in conjunction with a thickening agent, a filtration control agent, and/or a sealant, of at least protecting the chemical integrity of a core sample without substantial additional viscosification during transport to the surface in response to a decrease in temperature. However, normally viscous polyglycols do not hold the core sample together as firmly as polyglycols which actually harden during transport and may not be capable of maintaining the mechanical integrity of the core sample as well as such polyglycols. Therefore, naturally viscous polyglycols, such as polypropylene glycol, are preferred for use in sampling formations where preservation of the mechanical integrity of the core sample is not as crucial. For example, polypropylene glycol might be appropriate to protect the chemical integrity of a core sample from a formation which is loosely held, cracked, or otherwise not highly consolidated.

Polypropylene glycols having a molecular weight over about 1000, more preferably between about 1200–4000, are preferred for use in the present invention. Polypropylene glycols having a molecular weight over 4000 also may be used with appropriate downward adjustments in the amount of filtration control agents.

Filtration control agents that may be desirable additives using polypropylene glycols include natural or synthetic thickeners and/or particulate sealing agents. Suitable thickeners include calcium carbonates, lignites, such as oxidized leonardite, fumed silica, and similar materials. A desirable amount of thickener would be an amount between about 1–10% by weight, preferably between about 1–5% by weight. A particulate sealing agent should be capable of sealing the pores of the core sample and preventing water and other gases or fluids from invading or escaping from the core sample. This sealing agent could be a thickening agent, itself, or a separate powder, such as calcium carbonate. If a separate powder is used, such as calcium carbonate, then that powder should be present at between about 10–60% by weight, and more preferably between about 30–40% by weight.

Depending upon the permeability of the formation, it may be desirable to use both "hard" and "soft" particulates to seal the pores at the outer surface of the core sample. Hard particulates include calcium carbonate and similar powders or graded materials. Softer particulates may be capable of filling gaps left by the hard particulates. Suitable soft particulates include polymeric materials such as AIRFLEX RP245™ (a polyvinyl acetate powder) and/or AIRFLEX 426™ (a polyvinyl acetate emulsion), which may be obtained from Air Products and Chemicals, Inc.

If the chosen polyalkylene derivative or polyglycol has a relatively low molecular weight, then thickening agents also may be required to prevent the polymer from liquefying at relatively high downhole temperatures. Liquefication of the polymer could lead to unwanted leakage of the encapsulating material from the core barrel and/or into the core sample. This is particularly true where the encapsulating material is comprised primarily of polyethylene glycol, polyethylene, or other relatively low molecular weight polyglycols or polyalkylene derivatives. A preferred thickening agent for such encapsulating materials is silica, fumed silica, or a silica gel. If the chosen polyglycol or polyalkylene derivative has a relatively high molecular weight, then it may be necessary to reduce the amount of particulates, powders, etc. contained in the encapsulating material in order to decrease the viscosity of the material for ease in handling. In general, the lower the molecular weight of the polyglycol or polyalkylene derivative the more thickeners, particulates, and/or viscosifying agents will be required to prevent the encapsulating material from liquefying downhole to the extent that it will escape from the core barrel.

Other desirable additives are additives that would increase the lubricity of the material but would not alter the protectivity of the encapsulating material.

Water-Based Encapsulating Materials

Although polyalkylene derivatives adequately protect a core sample under most circumstances, there may be instances where the polyalkylene derivatives could interfere with a correct evaluation of the sample. An example is where the formation being sampled contains mainly oil and very little gas or water. Under such circumstances, it is possible that the hydrocarbons in the encapsulating material could dissolve in the crude oil in the sample and contaminate the core sample. This could interfere with a correct analysis of the degree of oil saturation of the core sample. In such circumstances, a water-soluble encapsulating material that would preserve the integrity of the core sample without invading and contaminating the core sample would be desirable.

The present invention provides such a water-based encapsulating material, preferably comprising an expandable lattice type clay. The water-base causes the expandable lattice type clay to swell, forming a plastic mass which can be pumped into a core barrel to encapsulate the core sample and maintain the chemical and mechanical integrity of the sample during transport to the surface. Filtration control agents preferably are added to the encapsulating material to prevent water from penetrating into or interacting with the core. These control agents prevent the loss and/or invasion of water thickening agent, and, (b) a particulate sealing agent capable of (i) sealing the pores of the core sample, or (ii) bridging the pores of the core sample and permitting the thickening agent to adsorb to the bridge to seal the pores. The integrity of the core sample will be maximized if a pressure core barrel is used to transport the encapsulated core sample to the surface.

The water-based encapsulating materials of the present invention may be used to encapsulate core samples from substantially any formation. A preferred use is with formations having substantially any porosity that are believed to contain mainly crude oil and very little gas or water. Another preferred use is with formations that are not primarily crude oil having a relatively low porosity, in the range of about 12–13% or less. In a preferred embodiment, the encapsulating materials are comprised of plasticizing and filtering agents dispersed in a water-based dispersant.

The plasticizing agents of the present invention are clays, preferably water expandable, lattice type clays. A preferred type of clay is a montmorillonite-type swelling clay, such as calcium or sodium bentonite clay, most preferably sodium bentonite. Sodium bentonite is commercially available from numerous sources. For example, MILGEL™ is a sodium bentonite clay available from Baker Hughes INTEQ. Post Office Box 22111, Houston, Tex. 77222.

Although expandable or swellable clays are preferred for use as plasticizing agents, less swellable clays also may be used. However, the mixture of the clay and the other components of the encapsulating material must have the desired consistency or "plasticity." As used herein, an encapsulating material is "plastic," or has a "desired plasticity," if it is deformable enough to be pumped into a core barrel to surround the core sample, but stiff enough to resist deformation so that it encapsulates and protects the core sample during transport to the surface. Most clays are less swellable than predominantly sodium bentonite clay. If less swellable clays are used in the present invention, then more sealing agents and/or thickening agents will be required to obtain the desired plasticity.

In order to make the encapsulating material, the clay and other components should be mixed in a water-based dispersant, preferably water. A water solution may be used as the dispersant as long as the concentration of solute is low enough to permit the water to cause the clay lattice to expand sufficiently. Alternately, if a salt is desired in the composition, for example, to change the plasticity range of the composition, the clay may be hydrated and salt may be added to the composition later. For example, relatively low concentrations of sodium chloride or calcium chloride, may be added.

The order in which the components are added to the dispersant is important, and should be designed to achieve optimal hydration of the clay and maximum solubilization of the thickening agent. Generally, the thickening agent should first be solubilized in the water using high shear, for example, using a malt mixer. Thereafter, the clay should be dispersed in the water solution using the same high shear conditions. The sealing agents generally should be added last. When low concentrations of thickeners are used, better blending may be obtained by dispersing the clay in the water first.

The use of high shear conditions will not only disperse the clay particles, but also will create heat, which enhances the process of hydration and solubilization. Aging the clay at ambient or elevated temperatures also will enhance the process of hydration and solubilization.

Suitable water-soluble thickening agents are starches, guar gums, xanthan gums, polyacrylates, polyacrylamides, and AMPS/acrylamide copolymers. "AMPS" denotes 2-acrylamido-2-propane-sulfonic acid, which is available from Lubrizol. Preferred thickening agents are PYROTRO® and KEM SEAL®, both of which are AMPS/acrylamide copolymers available from Baker-Hughes INTEQ, Houston, Tex.

The particulate sealing agent should be capable of sealing and/or bridging the pores of the core sample to prevent the loss and/or invasion of water or other gaseous or fluid components from the core sample. As used herein, the term "sealing agent" shall refer to an agent that seals and/or bridges the pores in the core sample. The sealing agent may be the thickening agent, alone, or a separate powder comprised of both sealing agent and thickening agent.

Suitable particulate sealing agents are inert particulates, including calcium carbonate, silica, and barite. A preferred sealing agent is calcium carbonate. Suitable sealing agents are commercially available from nunerous sources. For example, all of the following are available from Baker Hughes INTEQ, Houston, Tex. MILBAR™ (a barite); MILCARB™ (a calcium carbonate); and, W.O.30(F)™ (a calcium carbonate).

In a preferred embodiment, water is used as a dispersant, and the following components are added to the water in the following percentages by total weight: water, 60–75%; clay, 8–18%; sealing agent, 12–25%; and thickener, 5–10%. As the amount of sealing agent is increased, the amount of thickening agent generally will decrease. A preferred embodiment includes: about 60–70% water; about 10–12% swellable clay, preferably refined sodium bentonite clay; a mixture of two different sealing agents, preferably (a) between about 8–10% by weight barite, and (b) between about 10–15% by weight calcium carbonate; and, about 2–4% AMPS/Acrylamide copolymer as a thickener. Another preferred embodiment includes: about 60–65% water; about 14–16% of a suitable clay, preferably refined sodium bentonite clay; about 14–17% calcium carbonate; and, about 2–4% AMPS/Acrylamide copolymer.

The proportions of the foregoing materials may vary depending upon the characteristics of the formation being sampled. For example, where the formation is relatively soft, a less viscous, or more plastic encapsulating material will be preferred. In contrast, where the core sample is from a harder, tighter formation, a more viscous, less plastic encapsulating material will be preferred. Depending upon the permeability of the formation, it may be desirable to use both "hard" and "soft" particulates to seal the pores at the outer surface of the core sample. Hard particulates include calcium carbonate and similar powders or graded materials. "Soft" particulates may be able to fill gaps left by the hard particulates. Suitable soft particulates include lignites, leonardites, and polymeric materials such as PYROTROL® and KEM SEAL®.

Other desirable additives are additives that would increase the lubricity of the material but would not alter the protectivity of the encapsulating material.

Use of the encapsulating materials of the present invention, alone, without using a pressure core barrel, should maintain substantially complete integrity of the core sample during transport. When compared to other available options that do not use a pressure core barrel, use of the encapsulating material of the present invention at least maximizes the chemical integrity of the core sample. If complete chemical integrity is required, then the present encapsulating material should be used in conjunction with a pressure core barrel. The use of both the encapsulating material and a pressure core barrel will virtually guarantee the chemical integrity of the core sample.

The invention may be used with any suitable drilling assembly having a core barrel. For example, the assembly is shown in U.S. Pat. No. 4,716,974, incorporated herein by reference, would be suitable. A preferred assembly is shown in FIG. 1, a diagrammatic cross-sectional illustration showing a simplified coring tool to be used with the present invention. The embodiment shown in FIG. 1 is in no way intended to limit the invention. Any number of coring tool designs may be used in conjunction with the theories and claims of the invention.

Referring to FIG. 1, coring tool 10 comprises an outer tube 12 concentrically disposed outside and around an inner tube 14 which holds the encapsulating material 16. Typically, the inner tube 14 is coupled within the drill string to a bearing assembly (not shown) so that the inner tube 14 remains rotationally stationary as the outer tube 12 and the bit rotate. Drilling mud flows through the annular space 18 between the outer diameter of the inner tube 14 and the inner diameter of the outer tube 12. Drilling mud continues to flow downward longitudinally within the annular space 18 of the tool 10, as needed.

A piston 20 having at its upper end a rabbit 22 is located at the bottom of the inner tube 14. The rabbit 22 has longitudinal chambers 24 adapted such that, once an appropriate level of pressure is reached, the encapsulating material 16 flows through said longitudinal chambers 24. As the core 26 enters the lower end of the inner tube 14, the core 26 presses upward against the piston 20, and the resulting pressure is translated to the encapsulating material 16. At some point, the pressure becomes sufficient to force the encapsulating material 16 through the longitudinal chambers 24 in the rabbit 22 to surround the core 26. Thus, the core sample is encapsulated by the encapsulating material as it enters the core barrel. This minimizes contact between the core sample and the drilling mud or coring fluid, and thereby enhances the reliability of the sampling procedure.

Once the desired core sample 26 is obtained, the core sample 26 is isolated using conventional means and the encapsulating material 16 is permitted to completely surround the core sample 26. The encapsulated core sample 26 then is transported to the surface using conventional means.

The invention will be more fully understood with reference to the following examples.

Experimental Procedure for Determining Filtrate Loss of Coring Gel

The following equipment and procedures were used to determine filtrate loss in the following examples.

Equipment

The equipment included an HTHP Filter Press Heating Jacket for 10 inch cell (500 ml. capacity) complete with back pressure receiver, manifold, thermometers, etc., obtained from OFI Testing Equipment, Houston, Tex. The back pressure receiver was fitted with a graduated plastic centrifuge tube to measure small filtrate volumes of <about 0.5 ml. The HTHP 10 inch cell was modified to take ¼ inch ceramic disc.

A Berea sandstone disc, 0.5 Darcy permeability, was used. Other permeability discs may be used for experimental work.

Test Procedure

1. The Heating Jacket was heated to test temperature (200° F.).

2. The sandstone disc was saturated with water for at least 24 hours, free water was blotted off of disc, and the disc was positioned in the bottom of cell.

3. The cap was secured on the bottom of cell; the valve stem was inserted in the cell cap; and, the valve stem was closed.

4. The cell was inverted and 100–150 ml of encapsulating material was added to the cell. (If the encapsulating material was solid at room temperature, then the material was heated to softening to pour into the cell.) The sample of encapsulating material completely covered the disc.

5. The cap was secured on top of cell; the valve stem was inserted into the cap; and, the valve stem was closed.

6. The cell was placed in the heating jacket, making sure that the valve stem in the bottom of the cell was closed.

7. $N_2$ was attached via a manifold to the top of the valve stem, and a desired $N_2$ pressure was applied to the cell. The top valve was opened ¼ turn.

8. The cell temperature was allowed to reach equilibrium with the furnace temperature.

9. The back pressure receiver was attached to the bottom of the valve stem, and a desired $N_2$ pressure was applied to the receiver.

10. The bottom valve stem was opened ¼ turn, and the timing of the filtration rate was begun immediately.

11. After 30 minutes, the bottom valve stem was closed, and the pressure in the receiver was released and removed from the valve stem. The amount of water in the inner tube was recorded. (A notation was made if fluid other than water was present.)

12. The top valve stem was closed, and the $N_2$ released. The cell was disconnected from the manifold and removed from the heating jacket. The cell was cooled to room temperature. The top valve stem was opened to relieve pressure in the cell before opening the cell for cleaning.

Preparation of Encapsulating Material in Examples 1–4

In each of the following examples, the thickening agent(s) were solubilized in the dispersant using a high shear mixer. Thereafter, the clay was hydrated in the dispersant. Then the sealing agent(s) were added. The samples were aged as indicated.

Interpreting the Test Results

The initial goal of Examples 1–4 was to achieve a "spurt loss" of 0.0 ml. In the HTHP filtration test, described under "test procedures," if the fluid loss is 0.0 ml after 30 minutes, the spurt rate assuredly is 0.0 ml. The fluid loss was measured as ml $H_2O$/30 mins. at 100 psi (68.9476 Newtons/$m^2$) pressure differential using a Berea sandstone disc of the indicated permeability.

EXAMPLE 1

Five different encapsulating materials (A–E) were formulated and tested for fluid loss according to the foregoing protocol. Table 1 reflects the results:

TABLE 1

| COMPONENT (gms) | A | B | C | D | E |
|---|---|---|---|---|---|
| Water | 100 | 100 | 100 | 100 | 100 |
| MILGEL ™ | 15 | 15 | 15 | 17.5 | 20 |
| MILBAR ™ | 15 | 15 | — | — | 15 |
| MILCARB ™ | 20 | 20 | 20 | 25 | 20 |
| W.O. 30(F) ™ | — | — | — | 5.0 | — |
| PYROTROL ® | 2.5 | 4.0 | 5.0 | 3.0 | — |
| KEMSEAL ® | — | — | — | 1.0 | — |
| FLUID LOSS (ml $H_2O$/30 min, 0.5 Darcy Berea sandstone disc) | | | | | |
| 65.6° C. (150° F.) | 0.05 | 0.03 | 0.05 | 0.6 | 4.6 |

Samples A–D, which exhibited a relatively low fluid loss, contained a thickening agent.

Sample E, which exhibited a relatively high fluid loss, contained no thickening agent.

EXAMPLE 2

The following two formulations were made with the following amounts of fluid loss:

TABLE II

| COMPONENT (gms) | A | B |
|---|---|---|
| Water | 100 | 100 |
| PYROTROL ® | 5.0 | 5.0 |

TABLE II-continued

| COMPONENT (gms) | A | B |
|---|---|---|
| MILGEL ™ | 25 | 25 |
| MILCARB ™ | 20 | 30 |
| FLUID LOSS (ml $H_2O$/30 min, 0.5 Darcy Berea sandstone disc) | | |
| 65.6° C. (150° F.) | 0.8 | 0.0 |
| 93.3° C. (200° F.) | — | 0.0 |
| 148.9° C. (300° F.) | — | 0.1 |

Sample B demonstrates the beneficial effect of adding a sealing agent to this composition.

EXAMPLE 3

An encapsulating material having the following composition was found to exhibit 0.0 ml/30 min. fluid loss at 65.6° C. (150° F.) and 93.3° C. (200° F.). At 148.9° C. (300° F.), fluid loss was 0.1 ml:

| | |
|---|---|
| Water | 100 gm |
| PYROTROL ® | 5.0 gm |
| MILGEL ™ | 25 gm |
| MILCARB ™ | 20 gm |

After aging for 24 hours at room temperature, the fluid loss was 0.0 ml/30 min. at 99.3° C. (200° F.) using a 0.5 Darcy Berea sandstone disc as the filter medium. Upon continued aging at room temperature to 72 hours, and the fluid loss increased to only 0.4 ml/30 min at 93.3° C. (200° F.).

EXAMPLE 4

In the following experiment, a portion of sodium bentonite was replaced with REVDUST™, a poorer grade of clay available from Milwhite, Inc., Houston, Texas. Additional filtration control agent (PYROTROL®) was added as fines to compensate for the change in clay composition. The encapsulating material included the following:

| | |
|---|---|
| Water | 100 gm |
| PYROTROL ® | 6.0 |
| MILGEL ™ | 16 |
| REVDUST ™ | 15 |
| MILCARB ™ | 15 |
| W.O. 30 (F) ™ | 5.0 |

The filtration characteristics of this composition at 93.3° C. (200° F.) and 68.9476 Newtons/$m^2$ (100 psi) are given in Table III:

TABLE III

| PERMEABILITY (DARCY) | FLUID LOSS/30 min. |
|---|---|
| 0.5 | 0.0 |
| 0.8 | 0.02 |

The results of the foregoing experiments indicate that the water soluble encapsulating materials of the present invention will effectively prevent fluid loss from core samples during transport to the surface.

EXAMPLE 5

The encapsulating material used in this experiment was based on polypropylene glycol, and had the following composition:

| Component | % |
|---|---|
| PPG-4000 ™ | 48.6 |
| AIRFLEX 426 ™ | 21.1 |
| CAB-O-SIL M-5 ™ | 1.1 |
| MIL-CARB ® | 24.6 |
| LIGCO ™ | 4.6 |

PPG-4000™ is polypropylene glycol having an average molecular weight of about 4000, obtained from Dow Chemical Co. AIRFLEX 426™ is a polyvinyl acetate emulsion, obtained from Air Products and Chemicals, Inc. LIGCO™ is an oxidized leonardite obtained from Baker Hughes INTEQ. CAB-O-SIL M-5™ is a formed silica, which was obtained from Cabot Corporation.

The following results were obtained:

Filtration Characteristics Under Indicated Conditions

| Temp.° F. | Pressure, PSI | Permeability | Filtration Rate (ml/30 min.) |
|---|---|---|---|
| 200 | 100 | 0.5 darcy | 0.0 |
| 200 | 100 | 0.8 darcy | 0.175(A)(B) |
| 200 | 200 | 0.5 darcy | 0.60 (B) |
| 175 | 100 | 0.5 darcy | 0.0 |
| 200 | 100 | 2.5 darcy | 0.0 |
| 200 | 250 | 0.8 darcy | 0.0 |
| 200 | 500 | 0.8 darcy | 0.0 |

A--Zero spurt loss.
B--No back pressure in receiving vessel as per test method.

A person of ordinary skill in the art will recognize that many modifications may be made to the present invention without departing from the spirit and scope of the present invention. The embodiment described herein is meant to be illustrative only and should not be taken as limiting the invention, which is defined in the following claims.

We claim:

1. A method for protecting chemical integrity of a core sample during transport from a subterranean formation to the surface comprising:

cutting a core sample from said subterranean formation using a drilling fluid;

encapsulating said core sample with an encapsulating material that is separate from said drilling fluid and comprises a property which renders said encapsulating material capable of protecting said chemical integrity of said core sample during transport from said subterranean formation to said surface, wherein said property is other than a property selected from the group consisting of a viscosity which increases in response to a decrease in temperature and an ability to solidify in response to a decrease in temperature; and transporting said encapsulated core sample from said subterranean formation to said surface.

2. The method of claim 1 wherein said core sample comprises a surface comprising pores and said encapsulating material comprises a sealing agent which seals said pores and prevents fluids from invading and from leaving said core sample.

3. The method of claim 2 wherein said encapsulating material is capable of protecting said chemical integrity of said core sample during transport from said subterranean formation to said surface in the absence of a change in surrounding conditions.

4. The method of claim 1 wherein said encapsulating material is capable of protecting said chemical integrity of said core sample during transport from said subterranean formation to said surface in the absence of a change in surrounding conditions.

5. A method for protecting chemical integrity of a core sample during transport from a subterranean formation to the surface comprising:

cutting a core sample from said subterranean formation using a drilling fluid;

encapsulating said core sample with an encapsulating material that is separate from said drilling fluid and comprises a property which renders said encapsulating material capable of protecting said chemical integrity of said core sample during transport from said subterranean formation to said surface in the absence of a chemical reaction, wherein said property is other than a property selected from the group consisting of a viscosity which increases in response to a decrease in temperature and an ability to solidify in response to a decrease in temperature; and transporting said encapsulated core sample from said subterranean formation to said surface.

6. The method of claim 5 wherein said core sample comprises a surface comprising pores and said encapsulating material comprises a sealing agent which seals said pores and prevents fluids from invading and from leaving said core sample.

7. The method of claim 6 wherein said encapsulating material also inherently is capable of protecting said chemical integrity of said core sample during transport from said subterranean formation to said surface in the absence of a change in surrounding conditions.

8. The method of claim 5 wherein said encapsulating material also inherently is capable of protecting said chemical integrity of said core sample during transport from said subterranean formation to said surface in the absence of a change in surrounding conditions.

* * * * *